US006696972B1

(12) United States Patent
Bryans

(10) Patent No.: US 6,696,972 B1
(45) Date of Patent: Feb. 24, 2004

(54) REMOTE CONTROLLING

(75) Inventor: Darryl J. Bryans, Natick, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 09/220,630

(22) Filed: Dec. 24, 1998

(51) Int. Cl.[7] ..... G08C 19/00

(52) U.S. Cl. ..... 340/825.72; 340/825.69; 340/825.22; 340/825.25; 348/180; 348/734; 368/47; 368/55

(58) Field of Search ..... 340/825.72, 825.69, 340/825.22, 825.25; 348/180, 734; 368/47, 55

(56) References Cited

U.S. PATENT DOCUMENTS 5,153,580 A * 10/1992 Pollack ..... 340/825.25
5,227,881 A * 7/1993 Wess et al. ..... 348/734
5,235,328 A * 8/1993 Kurita ..... 340/825.72
5,237,417 A * 8/1993 Hayashi et al. ..... 348/734
5,805,530 A * 9/1998 Youngberg ..... 368/47
5,835,665 A * 11/1998 Grossmeyer ..... 386/83
5,969,835 A * 10/1999 Kamieniecki et al. ..... 348/734
5,999,213 A * 12/1999 Tsushima et al. ..... 348/180
6,091,882 A * 7/2000 Yuen ..... 386/83

* cited by examiner

*Primary Examiner*—Michael Horabik
*Assistant Examiner*—Yves Dalencourt
(74) *Attorney, Agent, or Firm*—Fish & Richardson P.C.

(57) ABSTRACT

A portable remote control controls a target electronic device. The portable remote control includes a data receiver having an input port for receiving a variable parameter value of a target device, a real time clock for keeping the time of day, a wireless signal transmitter for transmitting the parameter values and the time of day.

11 Claims, 2 Drawing Sheets

REMOTE CONTROLLING

The invention relates to wireless remote controls for electronic devices

It is an important object of the invention to provide an improved remote control.

According to the invention, a portable apparatus for remotely controlling a target electronic device includes a data receiver for receiving a variable parameter value of a target device, a real time clock for keeping the time of day, a wireless signal transmitter for transmitting the parameter values and the time of day. The portable apparatus may be free of data entry keypad.

In another aspect of the invention, an electronic system includes a portable remote control device, which includes a data receiver for receiving a variable parameter value in a plurality of substantially identical target devices without the use of a keypad, a real time clock for keeping the time of day, and a wireless signal transmitter for transmitting the parameter values and time of day. The remote control device typically is free of a data entry keypad. Each of the plurality of substantially identical target units includes a signal receiver for receiving the parameter values from the remote control device, and parameter setting circuitry for setting the parameter value and for setting the time of day.

In still another aspect of the invention, a remote control system includes an input subsystem for inputting to the remote control system a parameter value for a controlled device. The input subsystem includes an interface with an inputting electronic device, disconnectable from the inputting device. The disconnectable interface is typically the exclusive manner for inputting the parameter value.

Other features, objects, and advantages will become apparent from the following detailed description, which refers to the following drawings in which.

Figure 1:
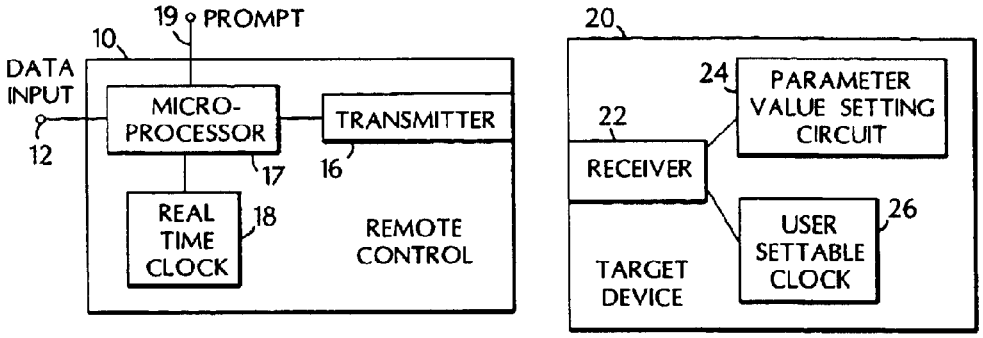
FIG. 1 is a block diagram of a remote control system according to the invention.

With reference now to the drawings and more particularly to FIG. 1, there is shown a block diagram of an embodiment of the invention. Remote control device 10 includes an input data port 12 coupled to a transmitter 16 by a microprocessor 17. Also coupled to microprocessor 17 are real time clock 18 and prompt 19. Target electronic device 20 includes a receiver 22 coupled to parameter setting circuit 24 and user settable clock 26. A typical system implementing the invention would include a plurality of substantially identical target electronic devices 20.

In operation, a controlling user sets device parameter values using a parameter setting electronic device, typically a computer running a parameter setting program. The device parameter values are input to remote control device 10 through input data port 12 and are stored in a memory associated with microprocessor 17. A setting user prompts remote control device 10 through prompt 19, causing microprocessor 17 to transmit parameter values stored in memory, and to transmit the time from real time clock 18. Receiver 22 in target electronic device 20 receives the transmitted parameter values and the transmitted time, and transmits them to the parameter value setting circuit 24. The parameter value setting circuit 24 uses the received values to set parameter values in the target electronic device 20 and to reset the user settable clock to the same time as in real time clock 18.

In one embodiment, remote control 10 is a remote control device with an infrared transmitter. Remote control device 10 is typically free of data entry keys, so that data input port 12 is the sole manner by which the desired parameter values can be entered into remote control 10. Target electronic device 20 may be a clock radio with an infrared receiver and with two alarms and station preset buttons, such as the WAVE radio commercially available from Bose Corporation of Framingham, Mass. Parameters may include designating whether or not user can reset the clock, whether or not user can use the second alarm, whether or not user can reset preset buttons, FM band presets, AM band presets, current radio volume or volume radio turns on to, current station or station radio turns on to, minimum radio volume, maximum radio volume, time format (e.g. standard, military) radio on/off, and whether or not alarms are cleared.

Figure 2:
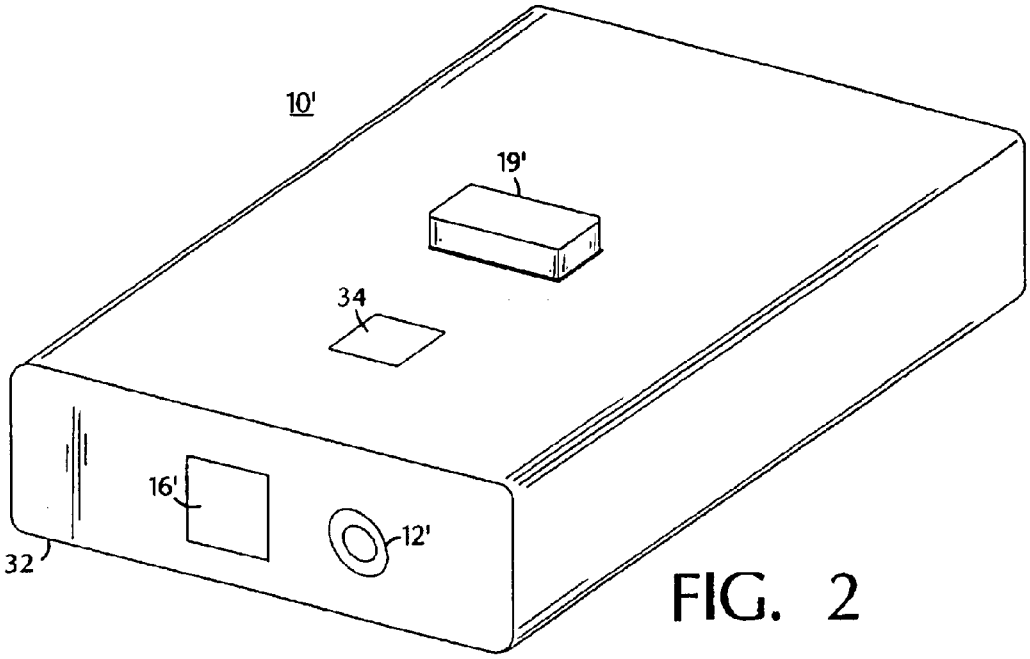
FIG. 2 is a perspective view of a remote control according to the invention.

Referring now to FIG. 2, there is shown a perspective view of a physical implementation of remote control device 10 according to the invention. In FIG. 2, prime (') designations refer to the physical implementations of corresponding elements of the block diagram of FIG. 1. Portable plastic enclosure 32 encloses electronic circuitry. Bi-directional input port 12' provides a data terminal for receiving a signal cable (not shown) to a computer to receive parameter values from a computer. Pushbutton 19' implements prompt 19 and causes the microprocessor 17 of FIG. 1 to transmit parameter values through infrared lens 16'. Light emitting diode 34 may provide information to a user, such as battery status or when transmitter 16 has transmitted a signal. If remote control device 10 is equipped with a receiver and target electronic device 20 is equipped with a transmitter, light emitting diode 34 may be used to indicate an acknowledgement by target electronic device 20 that the transmission has been received.

Figure 3:
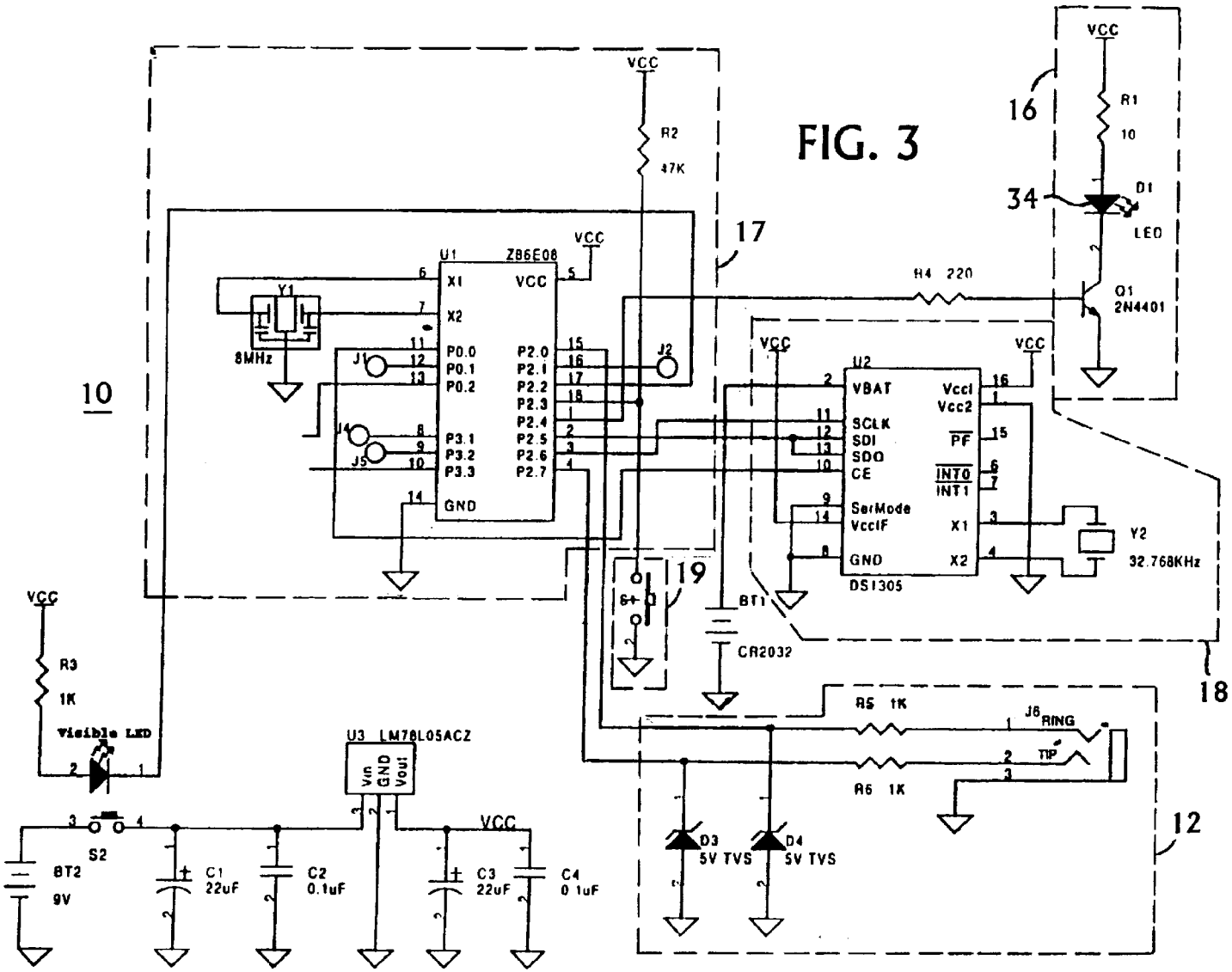
FIG. 3 is a schematic diagram of a circuit implementing the remote control of FIG. 1.

Referring now to FIG. 3, there is shown a schematic circuit diagram of an exemplary embodiment of remote control 10. Portions of the circuit enclosed in dashed lines and identified by reference numerals perform the functions of the elements of FIG. 1 having corresponding reference numerals. Portions of the circuit not enclosed in dashed lines and identified by reference numerals perform ancillary functions, such as power processing.

Figure 4:
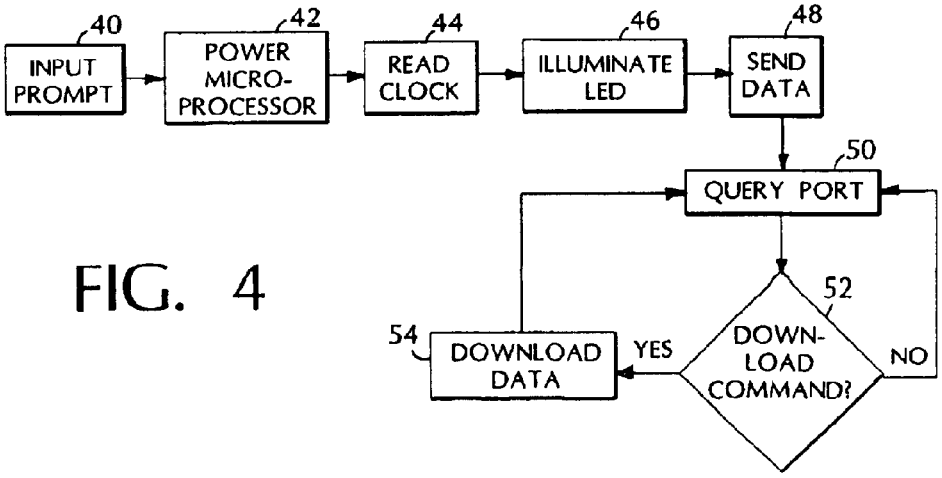
FIG. 4 is a flow diagram of the transmission of parameter values to the target device and of the acquisition of parameter values from the parameter setting electronic device.

Referring to FIG. 4, there is shown a flow diagram illustrating the transmission of parameter values to the target device and of the acquisition of parameter values from the parameter value setting electronic device. At step 40, prompt 19 is activated. At step 42, microprocessor 17 is powered. At step 44, microprocessor 17 reads the time from real time clock 18. At step 46, the light emitting diode 34 is illuminated. At step 48, microprocessor 17 transmits the parameter values through transmitter 16. At step 50, microprocessor 17 queries data input port 12 to see if there is a download command that has been issued by the parameter value setting electronic device. At step 52, if there is a download command present, microprocessor 17 downloads the parameter values at step 54. At step 52, f there is no download command the procedure returns to step 50, until the process is terminated by releasing prompt 19.

An example of a situation in which the invention might be applied is a hotel in which many or all rooms have substantially identical clock radios. Hotel guests may desire to reset the clock to a time zone other than local, or may set the time ahead to help them be on time for meetings. Hotel guests may reset the station preset buttons, may leave the alarm on, may leave the volume too high, and the like.

In such a situation, a remote control according to the invention is advantageous because the setting of parameter values from a computer allows a hotel management to easily set the parameter values in several remote controls identically, without having to set the remote controls individually. The remote control according to the invention is further advantageous because being free of a data entry keypad helps prevent data entry errors; parameter values may only be set by the parameter value setting electronic device, and cannot be erroneously changed subsequently. The resetting of parameter values of the target devices can be done quickly and efficiently by a member of the housekeeping staff by pushing a single button.

A system according to the invention is advantageous, because the controlled units need not be connected to a network and because it does not require expensive and complicated networking software.

Other embodiments are within the claims.

What is claimed is:

1. Portable apparatus for remotely controlling a target electronic device comprising:

a data receiver for inputting a variable parameter value of a target device;

a real time clock for keeping the time of day;

a wireless signal transmitter for transmitting said parameter value and said time of day.

2. Apparatus in accordance with claim 1, further comprising a data input port for receiving data signals from an external computer representative of desired parameter values.

3. Apparatus in accordance with claim 1, further comprising wherein said data receiver is constructed and arranged to receive a plurality of variable parameter values and wherein said wireless signal transmitter is constructed and arranged to transmit said plurality of parameter values and said time of day.

4. Apparatus in accordance with claim 1, wherein said wireless signal transmitter comprises an infrared radiation transmitting device.

5. Apparatus in accordance with claim 1, wherein said data receiver comprises an interface with a parameter value setting electronic device constructed and arranged to receive said variable parameter value from said parameter value setting electronic device.

6. Apparatus in accordance with claim 4, wherein said interface is the exclusive variable parameter value receiver.

7. Apparatus in accordance with claim 6, further comprising a prompt having an activated position and a non-activated position, wherein said interface is constructed and arranged to receive said parameter values only when said prompt is in said activated position.

8. Apparatus in accordance with claim 5, wherein said parameter value setting electronic device comprises a computer.

9. An electronic system comprising;

a portable remote control device, said remote control device comprising a data receiver having an input port for receiving a variable parameter value in a plurality of substantially identical target devices from an external computer;

a real time clock for keeping the time of day;

wireless signal transmitter for transmitting said parameter values and time of day; and wherein each of said plurality of substantially identical target units comprises a signal receiver for receiving said parameter values from said portable remote control device; and parameter value setting circuitry for setting said parameter value and for setting said time of day.

10. An electronic system in accordance with claim 9, wherein said data receiver is constructed and arranged to receive a plurality of variable parameter values;

wherein said signal receivers are constructed and arranged to receive said plurality of parameter values; and wherein said parameter value setting circuits are constructed and arranged to set said plurality of parameter values.

11. An electronic system in accordance with claim 9, further comprising a plurality of said remote control devices.

* * * * *